United States Patent [19]

Fischer et al.

[11] 4,416,652

[45] Nov. 22, 1983

[54] UNIT FOR SCORING WEBS OF PAPER IN THE LENGTHWAYS DIRECTION

[75] Inventors: Rudolf Fischer, Ludwigshafen-Oggersheim; Rudolf Stab, Wachenheim, both of Fed. Rep. of Germany

[73] Assignee: Albert-Frankenthal AG, Frankenthal, Fed. Rep. of Germany

[21] Appl. No.: 284,611

[22] Filed: Jul. 20, 1981

[30] Foreign Application Priority Data

Jul. 31, 1980 [DE] Fed. Rep. of Germany ..... 3029091

[51] Int. Cl.[3] ..... B26D 3/08; B31B 1/25

[52] U.S. Cl. ..... 493/399; 493/402; 83/887

[58] Field of Search ..... 493/396–404; 83/864, 872, 873, 884–887

[56] References Cited

U.S. PATENT DOCUMENTS

| | | | |
|---|---|---|---|
| 2,022,563 | 11/1935 | Hammisch | 493/402 |
| 2,139,890 | 12/1938 | Fitchett | 493/401 |
| 3,318,206 | 5/1967 | Kuehn | 493/397 |

FOREIGN PATENT DOCUMENTS

| | | | |
|---|---|---|---|
| 697347 | 11/1964 | Canada | 493/397 |

*Primary Examiner*—A. J. Heinz

*Attorney, Agent, or Firm*—Allison C. Collard; Thomas M. Galgano

[57] ABSTRACT

For the purpose of helping in the making of a second lengthways fold in a web of paper in a folder having a folder blade for producing this fold, the paper is firstly scored at the desired fold position in the long direction by a sharp-edged wheel pushing the paper against a turning back-up part, which is let into the face of one of the nipper or guiding rolls of the folder. The wheel with the sharp edge is placed on the other, opposite roll between separate roll parts or wheels thereon gripping the web against the other roll.

5 Claims, 2 Drawing Figures

UNIT FOR SCORING WEBS OF PAPER IN THE LENGTHWAYS DIRECTION

BACKGROUND OF THE INVENTION

Figure 1:
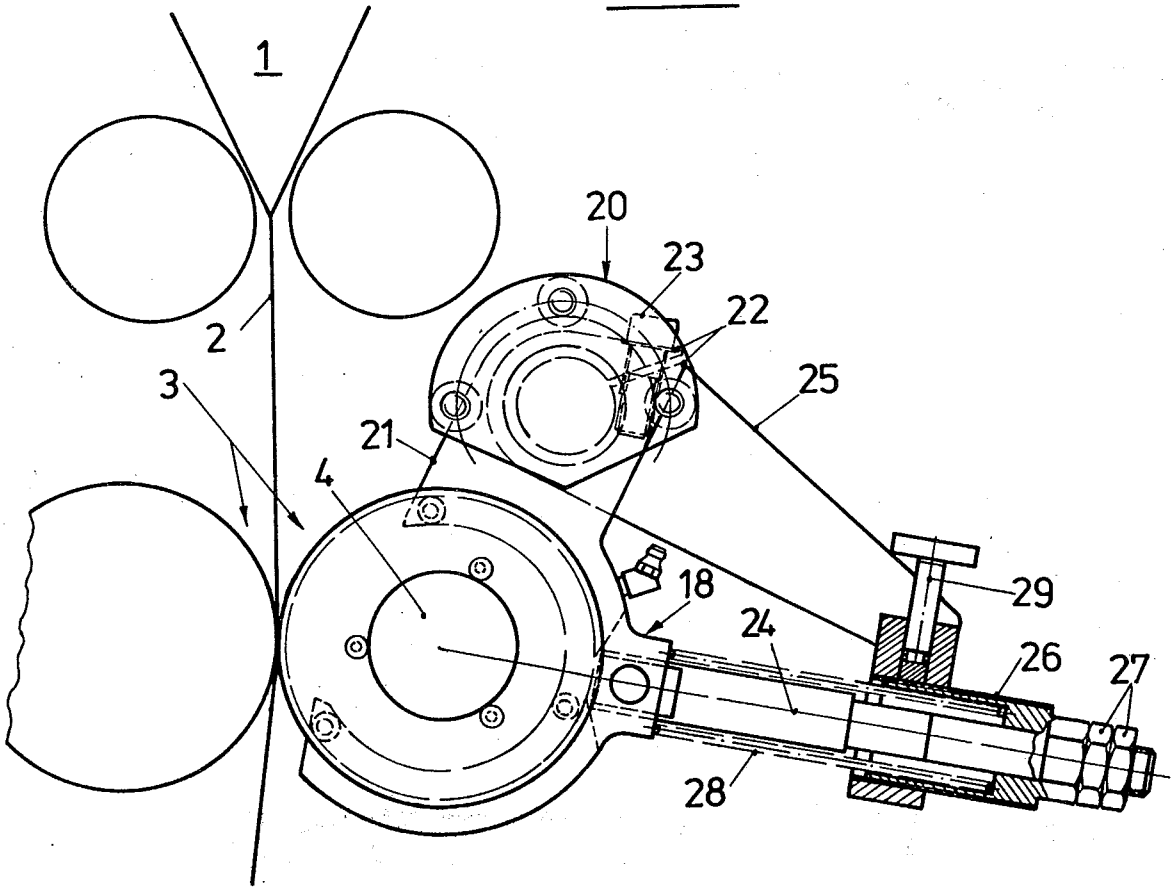

The present invention is with respect to a grooving or scoring unit, made up of a knife-edged wheel and a back-up part placed on the two sides of a moving web of paper being pulled along and transported by two rolls (of which at least one has a driving system) in, more specially, a folder having a folder blade for producing a second lengthways fold along the groove or score line in said web before the paper comes from the folder as folded products.

The grooving or scoring of paper webs at the positions of the second lengthways fold to be produced using a folder blade is responsible for more accurate or neater operation of the folder blade. In the prior art a separate grooving unit or station has been used placed upstream or downstream from the transport or nipper rolls. This makes the design of the system more complex, and takes up much space as is generally not to be desired.

SHORT OVERVIEW OF THE INVENTION

Taking such a prior art system as a starting point, one purpose of the present invention is that of taking care of the shortcomings of known systems and designing a grooving or scoring unit of the sort named which is simple in structure and may be so placed as to take up little space. A further purpose is the design of such a unit not needing a separate driving system of its own.

This purpose and further purposes may be effected in a surprisingly simple way by the present invention inasfar as the grooving or scoring wheel is fixed on a collar, the outer edge of the wheel acting against the back-up part turningly supported in the machine frame, the collar being placed with play on a shaft having transport rolls and being designed to be turned by the shaft.

Using these measures of the invention a combined grooving and transporting unit is produced of good effect for transporting the paper by a pulling force. Because the grooving part and the transport part are made into a single unit only very little space is needed and furthermore the grooving and transport function (by pulling) makes do with a common driving system so that, again, there is a further reason for making the system less complex. Nevertheless the scoring or grooving unit may be put into and out of operation or adjusted in a sideways direction in a way completely separate from the operation of the transport out of the unit. Because so much less space is needed and no separate driving system is necessary, the invention may be well used for fitting to an existing folder.

As a useful further development of the general teaching of the invention for driving the collar supporting the scoring wheel is is possible to have a self-aligning coupling or clutch, that is to say one letting the collar be moved radially so that it is no longer centered on the shaft, this being necessary for putting the scoring unit into and out of operation by moving the scoring wheel a small distance radially in relation to its shaft.

As part of a useful further development of the general teachings of the invention the support part used for the scoring wheel may take the form of a bearing housing in which the collar is supported and which is turningly supported on a carriage which may be slipped along a support rod fixed to the frame of the folder and which may undergo adjustment using a positioning system on the carriage. Such a design makes it readily possible, as may clearly be seen, for the scoring wheel to be moved sideways for adjustment and to be moved radially in relation to the shaft as may well be necessary for getting the best possible scoring effect in view of the quality of paper which may be being processed at any given time.

The back-up part for use with the scoring wheel may take the form of a two-piece ring taken up in a special groove of the transport roll or nipper roll opposite to the transport wheel on the shaft driving the scoring wheel. Such a two-piece ring may readily be put in position and makes possible the use of a material having different properties to the material of the nipper roll in view of the effect of the scoring operation thereon.

LIST OF FIGURES

Further useful developments and outgrowths of the general teachings of the present invention will be made clear in the account now to be given of one working example of the invention using the figures, and from the dependent claims.

FIG. 1 of the working example makes it clear how the grooving or scoring unit, which is further designed for pulling along the paper web, may be placed downstream from a folder former.

Figure 2:
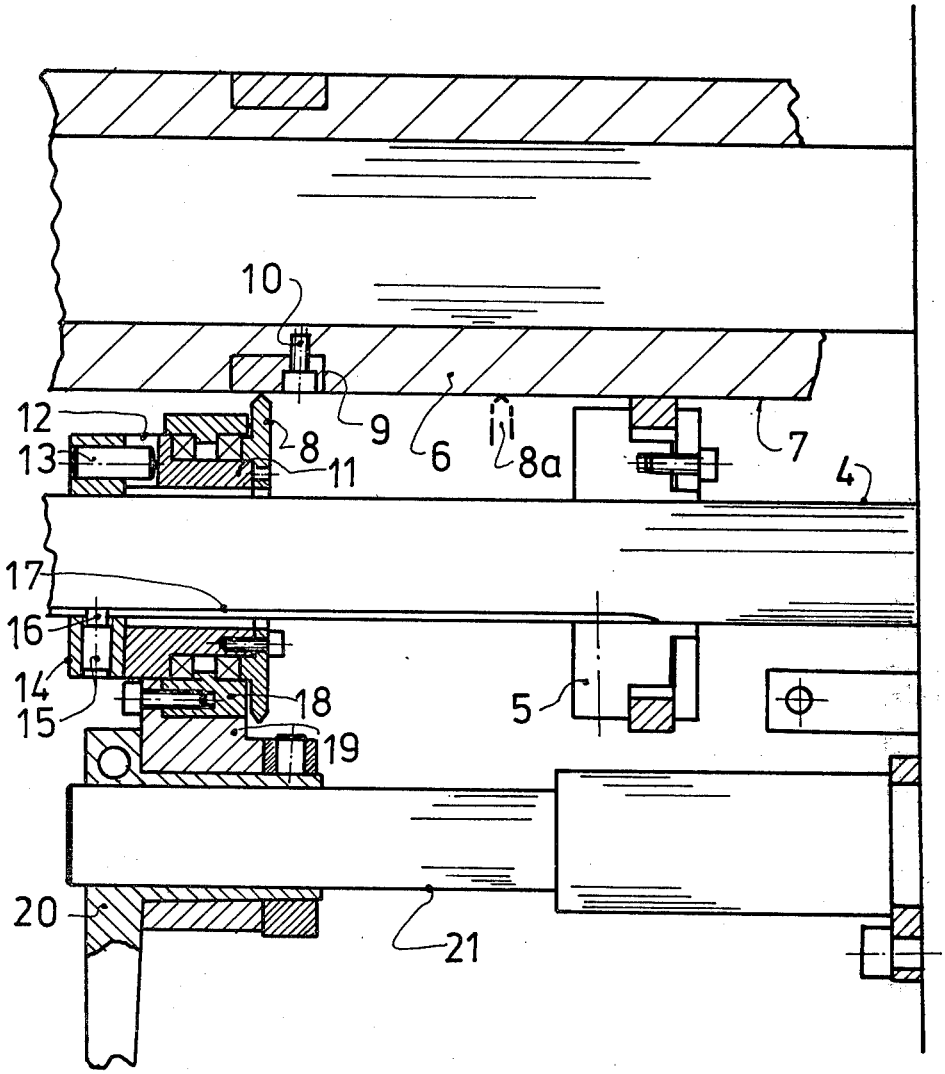

FIG. 2 is a plan view of the unit of FIG. 1, partly in section.

DETAILED ACCOUNT OF WORKING EXAMPLE

In FIG. 1 a folder former is numbered 1, along which the paper web 2 is guided. As the paper web comes from the folder former a first lengthways fold is produced in it before running into a folder (not to be seen in detail) downstream from the folder former 1 and designed for producing a right angle or cross-fold, whereafter the paper is again folded in the length direction. Placed downstream from the folder former 1 there is a combined pulling or transporting and grooving unit 3 responsible for forwarding the paper web and grooving or scoring the same for marking out the second lengthways fold.

For transporting the web two pulling rolls are used which may best be seen in FIG. 2. One of these rolls is made up of a shaft 4 stretching from one side of the folder to the other and having a number of puller wheels, of which one may be seen at 5, spaced out along its length. Shaft 4 has a driving gear or the like (not figured) near the side wall of the machine. The other puller roll, having its outer face 7 supporting the paper web acted upon by wheels 5, takes the form of a simple tube 6 which is freely bearinged in the side walls or frames of the machine. For grooving or scoring the paper web running inbetween the wheels 5 and the tube 6 there is a knife-edged grooving or scoring wheel 8 groovingly pressing the paper web against a back-up part 9, which is best made of a two-piece ring of hardened steel placed in a specially made groove in the outer face of tube 6, the two ring halves being simply connected by countersunk screws 10. Scoring wheel 8 is fixed on a collar 11 placed on shaft 4 and having an inner diameter somewhat greater than the outer diameter of the shaft so as to give a certain amount of radial play for purposes to be made clear further on.

The collar 11 and for this reason the scoring wheel 8 are turned by way of a coupling which lets the collar be moved somewhat out of line with a driver ring 14 which is keyed on shaft 4 by way of a radial screw 15 whose inner end 16, acting as a key, is taken up in a keyway 17 running along the shaft 4. For joining up collar 11 with driver ring 14 the collar 11 has a radial groove 12 in its end opposite to the scoring wheel 8, this opposite end being made broader and taking the form of a flange. A pin 13, parallel to the axis of shaft 4, is fixed in driver ring 14 and has its other end within radial groove 12. The collar 11 supporting the scoring wheel 8 and placed round shaft 4 is supported on a support part (which in turn is supported on the machine frame) so that it may be freely turned.

This support may be seen in the working example presently addressed to be made up of bearing housing 18 placed round the collar 11 and which for its part is turningly supported, by way of sleeve 19, on a carriage 20, the carriage running on a support rod 21 which, fixed to the side frames of the machine, is parallel to shaft 4. Carriage 20 is, in the present working example, simply in the form of a ring which may be slid along rod 21 so that the support part generally and, for this reason the scoring wheel 8 joined thereto, may be moved between one roll or wheel 5 and the next one. For fixing the carriage 20 in position on the support rod 21 taking the form of a support slide, a gripper ring 22 (best seen in FIG. 1), is used which may be done up tight by way of a screw 23 so that, for moving the support part from one point to another, it is only necessary for screw 23 to be undone somewhat. The back-up part 9 is at a position where scoring is normally to take place. However it would furthermore be possible to have a number of such back-up parts or back-up rings spaced along the range of possible axial adjustment of scoring wheel 8. In the present working example, when the scoring wheel 8 is axially clear of back-up part 9, it may be simply used with the outer face 7 of puller or nipper roll opposite to the wheels 5 on shaft 4, as may be seen at 8*a* in FIG. 1. In any case, because scoring wheel 8 may be changed in position axially, exact axial adjustment is possible. The keyway 17 makes it simple for the driver ring 14 with its key 16 to be moved along the shaft 4. The driver ring 14 may for this reason be fixed generally speaking at any desired point along shaft 4 by doing up screw 15.

For putting the scoring wheel 8 into and out of operation, that is to say for starting and stopping scoring or grooving, the wheel 8 may be moved up against and moved clear of the outer face 7 of tube 6 or the back-part 9. To make this possible, the bearing housing 18, turningly supported by way of ring 19 on carriage 20 may be turned by a driving system for changing its position in relation to shaft 4 run through collar 11. Such a change in position of the scoring wheel 8 may take place because of the coupling formed by the radial groove 12 and the axial pin 13 letting collar 11 be moved so as to be out of line with driver ring 14 or in other words, giving the function of a self-alining clutch. The positioning system for moving the scoring wheel 8 into and out of its working position is made up, as may be best seen from FIG. 1, of a driver rod 24 turningly joined with bearing housing 18 and running through a sleeve 26, supported on one arm 25 of carriage 20, where it is supported by adjustment nuts 27 for taking up the leftwardly acting force of a spring 28 placed between sleeve 26 and bearing housing 18, round driver rod 24. Sleeve 26 has a male screw thread by which it is screwed into a threaded hole in arm 15 so that it may be used for adjustment of the acting spring force of spring 28, which is responsible for producing the desired force pushing wheel 8 against the back-up part 9. Sleeve 26 may be locked in position by a locking screw 29.

In the figures only one scoring wheel will be seen, although it would however be possible to have a number of such wheels spaced along the length of shaft 4, each placed between one wheel 5 and the next. Each scoring wheel would then have its own back-up part 9.

We claim:

1. A scoring unit for the lengthwise scoring of a web of paper, comprising first and second rolls for gripping two sides of said web and advancing said web, said first roll having a keyway running therealong;

means for driving at least one of said rolls; a collar mounted about said first roll and means allowing radial play between said collar and said first roll, said collar having a radial groove formed therein;

a sharp-edged wheel supported on said collar;

a back-up part disposed opposite to said sharp-edged wheel so as to cooperate therewith to score the web as it is fed therebetween;

coupling means for driving said collar from said first roll, comprising a driver ring mounted adjacent the collar and having a radial screw with an inner end functioning as a key by which it is keyed on said first roll allowing said driver ring to be keyed at a number of different positions along the first roll, and an axial pin extending from said ring for drivingly joining said ring with said collar, said pin being receivable in said radial groove in said collar, said collar being thereby permitted to float radially, and to be driven while out of round with respect to said first roll;

a support rod extending parallel to said rolls; and a carriage slidably supported on said support rod and connected to the collar for adjusting the position of said collar and sharp-edged wheel along the first roll.

2. The structure as claimed in claim 1 wherein said back-up part is a two-piece ring placed in a groove running round said second roll.

3. The structure as claimed in claim 1 having a bearing housing supporting said collar and itself rockingly supported on said carriage, and a positioning system for changing the position of said housing.

4. The structure as claimed in claim 1 having a gripping ring for locking said carriage on said support rod.

5. The structure as claimed in claim 1 wherein said rolls are part of a folder, said folder having a folder blade for producing a lengthways fold at the position of said line of scoring.

* * * * *